United States Patent [19]

Blankenship

[11] 4,184,237

[45] Jan. 22, 1980

[54] METHOD OF MAKING A CUSHION CONSTRUCTION

[75] Inventor: James O. Blankenship, Tupelo, Miss.

[73] Assignee: Sofisti-Caire Furniture Mfg. Inc., Baldyn, Miss.

[21] Appl. No.: 938,378

[22] Filed: Aug. 31, 1978

[51] Int. Cl.[2] ..... B68G 7/00

[52] U.S. Cl. ..... 29/91.1; 29/451; 5/481; 53/449; 53/474

[58] Field of Search ..... 5/355, 345 R, 481; 29/91.1, 451, 428; 53/449, 474

[56] References Cited

U.S. PATENT DOCUMENTS

| | | | |
|---|---|---|---|
| 2,147,362 | 2/1939 | Bloomberg | 5/481 X |
| 2,764,859 | 10/1956 | Hanselmann | 29/91.1 UX |
| 2,785,440 | 3/1957 | Toulmin | 29/91.1 UX |
| 3,048,938 | 8/1962 | Mears | 5/481 X |
| 3,083,496 | 4/1963 | Feinerman | 29/91.1 |
| 3,188,665 | 6/1965 | Snyder | 5/481 |
| 3,270,394 | 9/1966 | Marsh et al. | 29/91.1 |
| 3,403,414 | 10/1968 | Unger | 5/481 |

*Primary Examiner*—Charlie T. Moon
*Attorney, Agent, or Firm*—Edmond T. Patnaude

[57] ABSTRACT

A mixture of shredded polyurethane foam pieces and pieces of polyester matting is placed in a bag formed of polyester matting which is in turn placed in a cover formed of upholstery material to provide a soft, resilient seat cushion.

7 Claims, 4 Drawing Figures

METHOD OF MAKING A CUSHION CONSTRUCTION

The present invention relates in general to seat cushions, and it relates in particular to a new and improved cushion construction and method of making the cushion.

BACKGROUND OF THE INVENTION

Seat cushions of the type commonly used in overstuffed furniture generally comprise a resilient core enclosed in a cover or envelope formed of a suitable upholstery material. The resilient core may be an integral piece or slab of foam or it may be a large number of small pieces of shredded or cut foam. One disadvantage associated with the use of a foam slab is that the pieces of foam tend to shift or creep in the cushion which also changes the appearance and comfort of the cushion. Such creeping can be prevented by providing a large number of pockets in the cushion, but such a solution is expensive and is not compatible with many cushion designs. Also, when shredded foam has been used as the basic core material, it has been necessary to provide a layer of resilient material between the core and the top of the cover so that the individual foam pieces cannot be seen or felt through the cover. Unwoven matting of polyester fibers has been used extensively as a liner material for this purpose, and therefore, such matting is readily available at economical prices.

SUMMARY OF THE INVENTION

In accordance with one aspect of the present invention there is provided a new and improved seat cushion construction which minimizes the shifting or creeping of shredded foam pieces in a seat cushion by interspersing among the foam pieces a number of small pieces or chunks of polyester fiber matting. Some of these pieces of matting may be obtained from the trimmings or scrap from matting sheets used in other furniture pieces.

In accordance with another aspect of the invention the mixture of shredded polyurethane foam and polyester fiber matting is placed in a bag which itself is formed of polyester fiber matting and which is in turn enclosed by an upholstery cover. In this way the need for one or more sheets of matting to separate the upholstery cover from a thin bag holding the mixture is eliminated as is the corresponding assembly operation.

GENERAL DESCRIPTION OF THE DRAWING

A better understanding of the present invention may be had from a reading of the following detailed description taken in connection with the drawing wherein.

DETAILED DESCRIPTION OF THE INVENTION

Figure 1:
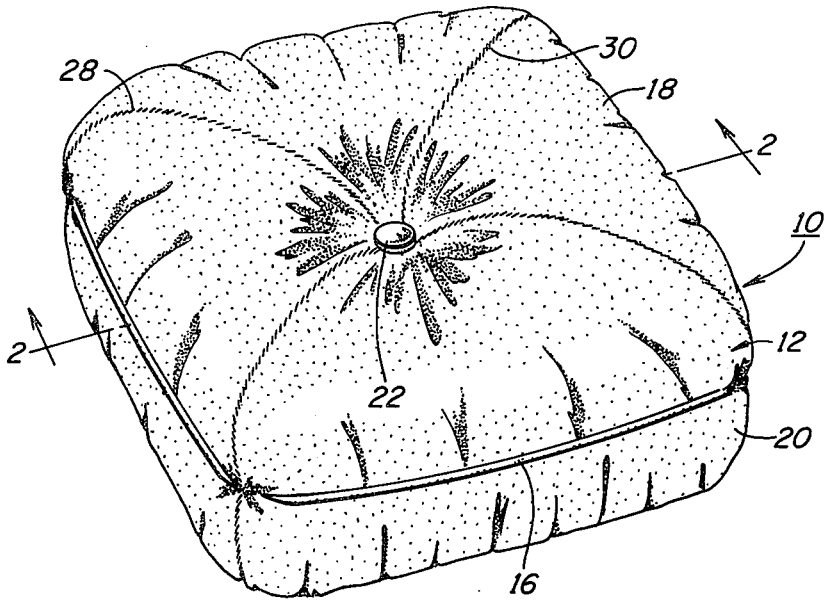
FIG. 1 is a perspective view of a seat cushion embodying the present invention.
Figure 2:
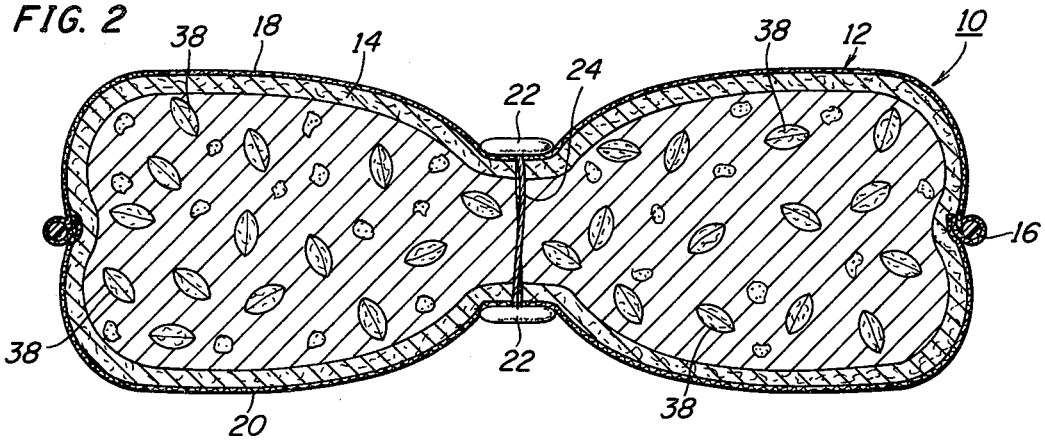
FIG. 2 is a cross-sectional view taken along the line 2—2 of FIG. 1.
Figure 3:
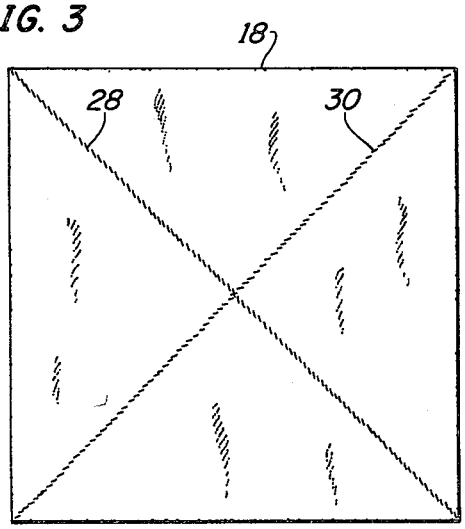
FIG. 3 is a view of the top panel of the upholstery cover prior to making the cover.
Figure 4:
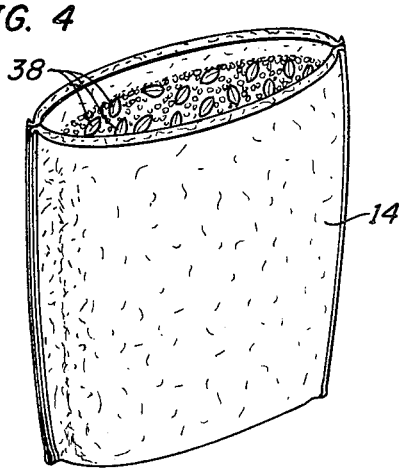
FIG. 4 is a view of the core during manufacture thereof.

Referring to FIGS. 1 and 2 of the drawing, a seat cushion 10 comprises and upholstery cover 12 enclosing a resilient core constituted by a bag 14 filled with a mixture of small pieces of polyurethane foam and small pieces of polyester matting. The cover 12 may be of any suitable design but in a preferred embodiment of the invention the cushion 10 is reversible and the cover 12 includes a peripheral bead 16 hinding the seam between the top and bottom panels 18 and 20 and a pair of buttons 22 attached together by a cord 24. A conventional opening (not visible in the drawing) may be provided at the rear of the cushion for insertion of the bag 14 into the upholstery cover 12 during assembly of the cushion. A zipper may be provided in the usual way for closing the opening after insertion of the foam filled bag 14.

In order to provide a crushed effect, the top and bottom panels, which are square, are initially sewn from corner to corner to provide diagonally extending stitch lines 28 and 30. The buttons 22 hold the center portions of the top and bottom panels in close proximity to hold the center of the cushion in compresson and thus provide the desired crushed effect.

In accordance with one aspect of the present invention the bag 14 is made from one or more sheets of melt-spun polyester matting or batting as it is sometimes called. Preferably this matting has a thickness of between one-half and one and one half inches in thickness. One such brand of matting material is sold by E. I. Du Pont De Nemours under the trademark DACRON. The bag 14 is initially left open at one end and is filled with a mixture of small pieces of a resilient foam such as polyurethane foam and pieces of melt-spun polyester matting. The pieces of foam and matting should be well mixed before being placed in the bag so that the pieces of matting are well dispersed throughout the mixture. The pieces of matting are used to reduce the tendancy of the foam pieces to shift or move relative to one another during use of the cushion.

The pieces of foam used in the cushion 10 may be obtained by shredding or cutting polyurethane foam bats, slabs or scrap into random size pieces preferably having an average minimum cross dimension of one-half inch and a maximum average cross dimension of two and one-half inches. The pieces of polyester matting preferably have dimensions of about two inches by two inches by one-inch, and may be cut from larger sheets or scrap pieces by means of hot cutting wires. The pieces of matting may, however, be larger or smaller if desired. Also, irregularly shaped pieces may be used.

We have found the mixture is preferably about twenty-five percent by volume polyester matting. This percentage is not critical, however, inasmuch as the optimum ratio of foam to matting depends on the sizes of the foam pieces and also on the particular cushion design. A mixture using twenty percent by volume matting has also been found to be satisfactory and it appears that up to fifty percent matting can be used if economical to do so. The above percentages are determined while the foam and matting are in the unstressed state. The particular shape or shapes of the pieces of matting is not critical although added resiliency can be obtained if the edges of the pieces are bonded together along a peripheral line 38 (FIG. 2) giving each piece the general shape of the well known charcoal brickette.

After the open bag 14 has been filled with the mixture it is sewn closed and inserted into the cover 12. The cover 12 then is closed and the bottons are attached to complete the cushion. The material from which the bag 14 is made is sufficiently thick and resilient so that the shapes of the foam pieces cannot be seen or felt through the cover of the outer cushion. In one embodiment of the invention, the bag material has a thickness of about one inch although thicknesses between one-half inch and one and one-half inches should be satisfactory.

If desired, the bag 14 can be made of porous sheeting but it is then necessary to line the cover 12 with a resilient batting such, for example, as melt-spun polyester matting. Such a liner should have a thickness in the range of about one-half inch to one and one-half inches to prevent the individual foam pieces from being seen or felt through the cover.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

I claim:

1. A method of making a seat cushion, comprising the steps of making a cushion cover of upholstery material, forming a porous bag with an opening, filling said bag with a mixture of pieces of shredded polyurethane foam and pieces of polyester fiber matting, securing said bag opening closed and inserting said filled bag into said cushion cover.

2. A method according to claim 1 wherein the percentage by volume of said pieces of matting in said mixture is between twenty and fifty percent.

3. A method according to claim 2 wherein said pieces of polyester foam each have a maximum dimension in the range of one-half inch to two and one-half inches.

4. A method according to claim 3 wherein said pieces of matting are at least as large in volume as said pieces of foam and are dispersed throughout the mixture.

5. A method according to claim 4 wherein said pieces of foam are approximately one inch by two inches by two inches in size.

6. A method according to claim 1 wherein said step of forming a porous bag comprises forming said bag from polyester fiber mat sheeting having a thickness between one-half inch and one and one-half inches.

7. A method according to claim 1 comprising the steps of positioning a sheet of polyester fiber matting between said bag and the top of said cover.

* * * * *